United States Patent [19]

Nimz

[11] Patent Number: 4,844,199

[45] Date of Patent: Jul. 4, 1989

[54] STAIR CLIMBING AID

[76] Inventor: Floyd E. Nimz, 138-15th Ave., Rockford, Ill. 61108

[21] Appl. No.: 249,107

[22] Filed: Sep. 26, 1988

[51] Int. Cl.[4] ..... A47C 9/12

[52] U.S. Cl. ..... 182/106; 182/132

[58] Field of Search ..... 182/106, 92, 131, 132, 182/130, 228, 230

[56] References Cited

U.S. PATENT DOCUMENTS

| | | | |
|---|---|---|---|
| 3,207,260 | 9/1965 | Castagna | 182/106 |
| 3,578,110 | 5/1971 | Seagraves | 182/106 |
| 3,826,336 | 7/1974 | Cramer | 182/106 |
| 3,841,437 | 10/1974 | Caughey | 182/106 |
| 3,884,327 | 5/1975 | Zigman | 182/106 |
| 4,113,161 | 9/1978 | Manuzak | 182/106 |
| 4,250,977 | 2/1981 | Deli | 182/106 |
| 4,378,862 | 4/1983 | Carmel | 182/106 |

*Primary Examiner*—Reinaldo P. Machado

*Attorney, Agent, or Firm*—Leydig, Voit & Mayer, Ltd.

[57] ABSTRACT

A device for helping a handicapped person move up and down a flight of stairs. The device includes a base having a pair of vertically spaced platforms which define intermediate steps between the steps of the stairs. By stepping from a lower step to the platforms and then to the adjacent upper step, a person may climb the stairs while lifting his feet vertically through only relatively short distances. A handle extends upwardly from the base and helps stabilize the person using the device. The handle also is used to move the device from step to step.

7 Claims, 1 Drawing Sheet

STAIR CLIMBING AID

BACKGROUND OF THE INVENTION

Certain handicapped people have the ability to walk and the ability to lift their feet through a limited distance but cannot lift their feet sufficiently high to climb a flight of stairs. Thus, such people need assistance when traveling up and down steps.

SUMMARY OF THE INVENTION

The general aim of the present invention is to provide a relatively simple, inexpensive and lightweight device for assisting a handicapped person in moving from step to step with relative ease and safety.

A more detailed object of the invention is to achieve the foregoing by providing a portable device which itself defines a pair of comparatively short steps adapted to be placed between adjacent steps of a flight of stairs and adapted to assist a person in moving up or down the stairs.

The invention also resides in the unique construction enabling the device to be lightweight but sturdy and stable and enabling the device to be used conveniently by persons of various heights.

These and other objects and advantages of the invention will become more apparent from the following detailed description when taken in conjunction with the accompanying drawings.

DETAILED DESCRIPTION OF THE PREFERRED EMBODIMENT

Figure 1:
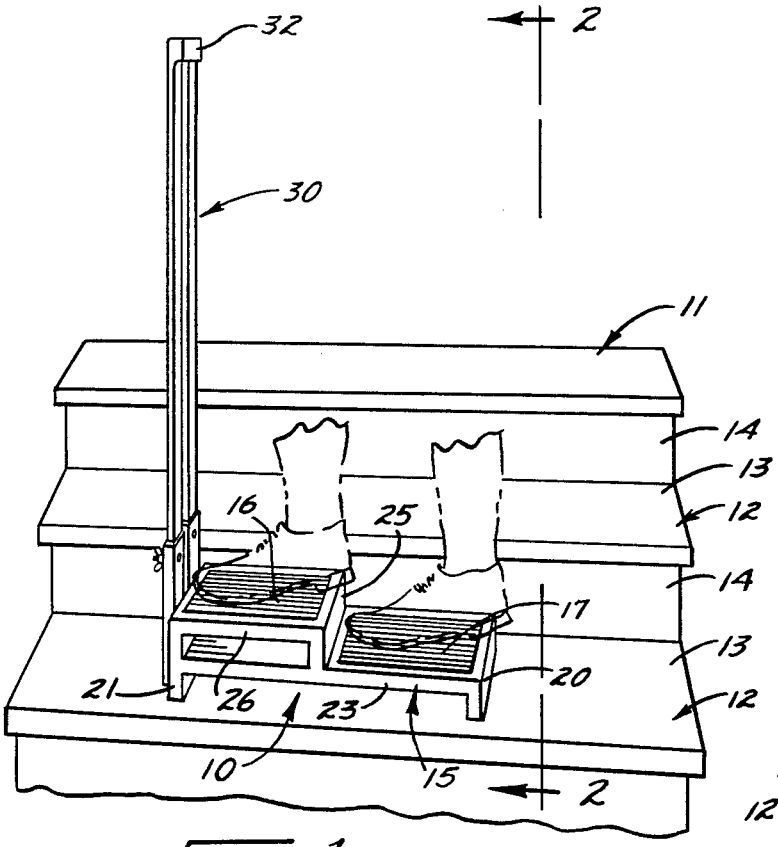
FIG. 1 is a perspective view showing a new and improved device incorporating the unique features of the present invention in place on a typical flight of stairs.

As shown in the drawings for purposes of illustration, the invention is embodied in a device 10 for helping a handicapped person move up and down a flight of stairs 11. The flight includes several steps 12 each having a horizontal tread 13 and a vertical riser 14. As is conventional, the vertical distance between the treads 13 of adjacent steps 12 is about 7".

Some handicapped people have little difficulty in standing or walking but cannot lift their feet sufficiently high to reach from one step to another. The present invention contemplates the provision of a portable and very stable device 10 which defines a pair of intermediate steps and which may be placed on the stair steps 12 to help the handicapped person safely move from step to step.

More specifically, the device 10 comprises a base 15 having upper and lower platforms 16 and 17 which respectively define upper and lower stair treads. The base may be fabricated from pieces of wood but preferably is a single piece of rigid plastic.

Figure 4:
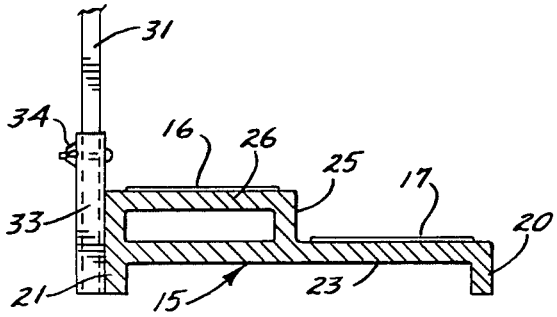

In the preferred embodiment, the one-piece plastic base 15 includes a front vertically extending riser 20 (FIG. 4) and a rear vertically extending riser 21, the height of the rear riser 21 being approximately twice that of the front riser 20. A horizontal member 23 extends from the rear riser 21 to the upper end of the front riser 20 and part of its upper surface defines the lower platform or stair tread 17 of the device 10.

A third riser 25 (FIG. 4) extends upwardly from the horizontal member 23 about midway along the length of the latter. Extending between the upper ends of the risers 21 and 25 is a second horizontal member 26 whose upper surface defines the upper platform or stair tread 16 of the device 10. In addition to being spaced vertically from the lower platform 17, the upper platform 16 is spaced from the lower platform along the length of the steps 12.

In the present instance, each of the platforms 16 and 17 is a 10" square. The upper platform 16 is located 2½" above the lower platform 17 while the latter platform is located 2½" above ground. Each of the platforms preferably is covered by an anti-slip mat.

Figure 2:
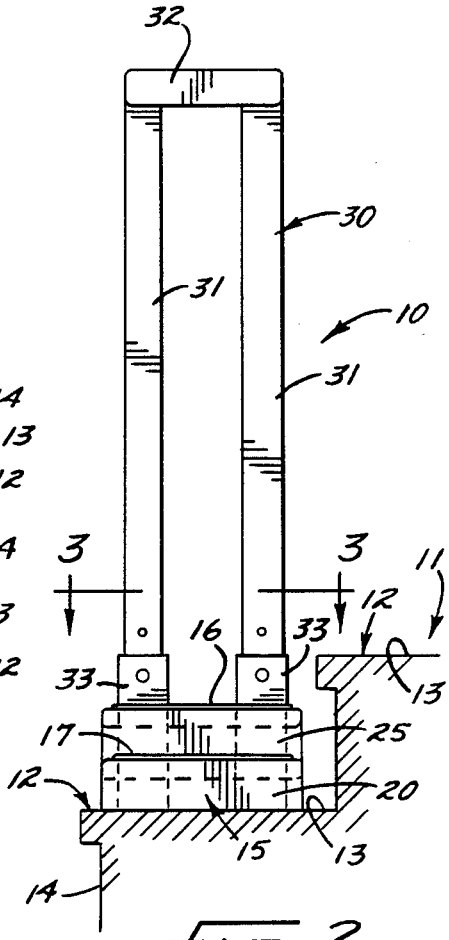
FIG. 2 is an enlarged and elevational view of the device as taken along the line 2—2 of FIG. 1.
Figure 3:
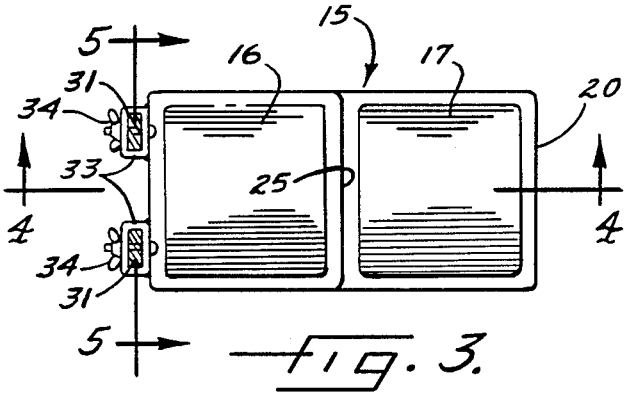
FIG. 3 is a cross-section taken along the line 3—3 of FIG. 2.
Figure 5:
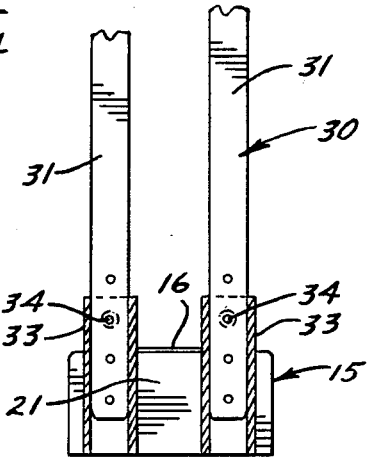
FIGS. 4 and 5 are fragmentary cross-sections taken along the lines 4—4 and 5—5, respectively, of FIG. 3.

A lifting handle 30 extends upwardly from the base 15 at a location adjacent the rear riser 21. While the handle may be of various constructions, it herein is formed by a pair of vertical struts 31 (FIG. 2) whose upper ends are connected by a transversely extending horizontal bar 32. The lower end portion of each strut 31 is telescoped slidably into an upwardly opening sleeve 33 of rectangular cross-section attached to the rear face of the rear riser 21. Bolts 34 extend through holes in the struts 31 and the sleeves 33 in order to secure the struts to the sleeves. Several vertically spaced holes may be formed in each strut in order to enable the handle 30 to be raised or lowered to best fit the height of the person using the device 10.

In use, the device 10 is placed on the tread 13 of a step 12 and is oriented such that the risers 20, 21 and 25 of the device extend at right angles to the risers 14 of the steps. With the device 10 so oriented, the person positions himself sidewise on one of the steps 12, grabs the bar 32 with his hands and then lifts one of his feet from the tread 13 of the step 12 to the lower platform 17 of the base 15. This is followed by moving the other foot from the tread 13 to the platform 17. Thereafter, the person first lifts one foot and then the other from the lower platform 17 to the upper platform 16. The person then lifts one foot sidewise from the upper platform 16 to the tread 13 of the adjacent upper step 12 and thereafter lifts his other foot in a similar manner. Using the handle 30, the person then lifts the device 10 to the upper step 12 and repeats the process. If the person's handicap is less severe, he may use the device 10 by placing one foot on the lower platform 17 and then immediately moving the other foot to the upper platform 16. The device may be used in a reverse manner to help the person move down the stairs 11.

From the foregoing, it will be apparent that the present invention brings to the art an extremely simple device 10 which may be used to help a handicapped person move up and down a flight of stairs. By using the device 10, it usually will not be necessary for the person to lift his feet through a distance of more than 2½". Also, the device is stable since it rests on feet defined by the lower end portions of the risers 20 and 21 and does not have legs which could drop off the edge of a stair tread.

I claim:

1. A device for assisting a handicapped person in traveling up and down a flight of stairs having vertically spaced steps, said device comprising a base adapted to rest on the tread of a step, said base including a lower platform disposed in a horizontal plane and having an upper surface located above the tread of the step, said base having an upper platform disposed in a horizontal plane and located above the upper surface of the lower platform, said upper platform being spaced from said lower platform along the length of the step whereby said platforms define a pair of stair treads located between and extending generally at right angles to the treads of adjacent steps, and a handle connected to and extending upwardly from said base to facilitate moving said device from step to step.

2. A device as defined in claim 1 in which said upper platform has one end located adjacent said lower platform, said handle extending upwardly from said base at a location adjacent the opposite end of said upper platform.

3. A device as defined in claim 2 in which said handle comprises a pair of upwardly projecting struts spaced from one another along said opposite end of said upper platform, and a horizontal bar extending between and joined to the upper ends of said struts.

4. A device as defined in claim 1 further including means enabling selective adjustment of the effective height of said handle.

5. A device as defined in claim 1 in which said base includes first and second upright risers spaced longitudinally along and extending transversely of said step, said first riser having a greater height than said second riser, a lower horizontal member extending between and joined to said first riser and the upper end of said second riser, a portion of said horizontal member defining said lower platform, a third riser extending transversely across and projecting upwardly from said horizontal member about midway along the length thereof, and an upper horizontal member extending between and joined to the upper ends of said first and third risers and defining said upper platform.

6. A device as defined in claim 5 in which said handle extends upwardly from said base at a position adjacent said first riser.

7. A device as defined in claim 1 in which said upper platform is spaced approximately $2\frac{1}{2}$ inches above said lower platform.

* * * * *